US009168410B2

(12) United States Patent
Palumbo et al.

(10) Patent No.: US 9,168,410 B2
(45) Date of Patent: Oct. 27, 2015

(54) METHOD AND DEVICE FOR AGITATING A GROUPING OF CUSHIONING ARTICLES

(71) Applicant: Team USA Productions, LLC, Phoenixville, PA (US)

(72) Inventors: Richard A. Palumbo, Phoenixville, PA (US); Christian Palumbo, Phoenixville, PA (US)

(73) Assignee: TEAM USA PRODUCTIONS LLC, Phoenixville, PA (US)

( * ) Notice: Subject to any disclaimer, the term of this patent is extended or adjusted under 35 U.S.C. 154(b) by 0 days.

(21) Appl. No.: 14/350,063

(22) PCT Filed: Feb. 9, 2013

(86) PCT No.: PCT/US2013/025462

§ 371 (c)(1),
(2) Date: Apr. 4, 2014

(87) PCT Pub. No.: WO2013/120039

PCT Pub. Date: Aug. 15, 2013

(65) Prior Publication Data

US 2014/0230154 A1 Aug. 21, 2014

Related U.S. Application Data

(60) Provisional application No. 61/597,261, filed on Feb. 10, 2012.

(51) Int. Cl.

| | |
|---|---|
| ***A63B 6/02*** | (2006.01) |
| ***A47C 27/08*** | (2006.01) |
| ***A47C 27/10*** | (2006.01) |

(52) U.S. Cl.

CPC ..... *A63B 6/02* (2013.01); *A47C 27/081* (2013.01); *A47C 27/10* (2013.01)

(58) Field of Classification Search

CPC .... A47C 27/08; A47C 27/081; A47C 27/087; A47C 27/10; A61G 7/05769; A61G 7/05776; A62B 1/22; A62B 1/00; A63B 26/00; A63B 6/02

USPC ..... 5/706, 710–713, 655.3, 654, 644, 689, 5/655.4, 702, 911; 482/14, 15, 23, 142; 182/137

See application file for complete search history.

(56) References Cited

U.S. PATENT DOCUMENTS

| | | | |
|---|---|---|---|
| 562,448 | A | 6/1896 | Zedora |
| 1,166,811 | A | 1/1916 | Bowers |

(Continued)

FOREIGN PATENT DOCUMENTS

| | | | |
|---|---|---|---|
| FR | 2 495 481 | A1 | 6/1982 |
| GB | 2 026 877 | A | 2/1980 |

*Primary Examiner* — Robert G Santos

(74) *Attorney, Agent, or Firm* — Condo Roccia Koptiw LLP

(57) ABSTRACT

An apparatus and method for agitating and rearranging a grouping of individual cushioning articles in an enclosed container are disclosed. The method and device may protect and individual from an injury resulting from landing in the enclosed container when the individual cushioning articles are overly compressed and lack appropriate spacing in order to absorb the kinetic energy of an individual landing in the enclosed container. The apparatus may include an air actuated inflatable bladder with inflatable extensions that may be utilized to lift and/or separate the cushioning articles, thus allowing the cushioning articles to be repositioned in a random, non-uniform, fashion. Additionally, the repositioned cushioning articles may have additional air space introduced between the individual cushioning devices, thereby allowing the cushioning device to absorb the kinetic energy and an individual without inducing as large an impact force, and providing a more compressive landing zone free of compacted and lodged pieces.

20 Claims, 10 Drawing Sheets

(56) References Cited

U.S. PATENT DOCUMENTS

| | | | | | |
|---|---|---|---|---|---|
| 1,985,432 | A | | 12/1934 | Tucker et al. | |
| 2,797,853 | A | | 7/1957 | James | |
| 2,906,366 | A | | 9/1959 | Mapes | |
| 2,975,855 | A | | 3/1961 | Dudek | |
| 3,095,947 | A | | 7/1963 | Beaulaurier | |
| 3,250,065 | A | | 5/1966 | Frost | |
| 3,310,818 | A | | 3/1967 | Fischer | |
| 3,369,808 | A | | 2/1968 | Sconce | |
| 3,391,414 | A | | 7/1968 | Gordon | |
| 3,399,407 | A | | 9/1968 | Olsen | |
| 3,840,922 | A | | 10/1974 | Morrison et al. | |
| 3,851,730 | A | | 12/1974 | Scurlock | |
| 4,065,124 | A | | 12/1977 | Egan | |
| 4,068,739 | A | | 1/1978 | Gordon | |
| 4,159,113 | A | | 6/1979 | Callecod | |
| 4,215,857 | A | | 8/1980 | Gordon | |
| 4,431,182 | A | | 2/1984 | Reynolds | |
| 4,606,087 | A | * | 8/1986 | Alivizatos | 5/424 |
| 4,637,083 | A | | 1/1987 | Goodwin | |
| 4,689,844 | A | * | 9/1987 | Alivizatos | 5/702 |
| 4,875,548 | A | | 10/1989 | Lorsbach | |
| 4,947,500 | A | * | 8/1990 | Seiler | 5/713 |
| 5,394,577 | A | * | 3/1995 | James et al. | 5/713 |
| 5,643,139 | A | | 7/1997 | Stout et al. | |
| 5,713,817 | A | | 2/1998 | Buchanan | |
| 5,769,725 | A | | 6/1998 | Ogden et al. | |
| 5,772,535 | A | | 6/1998 | Murphy | |
| 5,956,787 | A | * | 9/1999 | James et al. | 5/713 |
| 5,970,550 | A | * | 10/1999 | Gazes | 5/715 |
| 6,085,372 | A | * | 7/2000 | James et al. | 5/713 |
| 6,240,584 | B1 | * | 6/2001 | Perez et al. | 5/713 |
| 6,250,668 | B1 | | 6/2001 | Breed et al. | |
| 6,418,579 | B2 | * | 7/2002 | Perez et al. | 5/713 |
| 6,558,264 | B2 | | 5/2003 | Gordon | |
| 6,568,013 | B2 | * | 5/2003 | Perez et al. | 5/710 |
| 6,721,979 | B1 | * | 4/2004 | Vrzalik et al. | 5/689 |
| 7,210,976 | B2 | | 5/2007 | Gordon | |
| 7,357,728 | B2 | | 4/2008 | Osler-Weppenaar | |
| 7,462,142 | B1 | | 12/2008 | Gordon | |
| 2001/0023512 | A1 | | 9/2001 | Perez et al. | |
| 2002/0133883 | A1 | * | 9/2002 | Perez et al. | 5/713 |
| 2008/0318733 | A1 | | 12/2008 | Osler-Weppenaar | |
| 2012/0311787 | A1 | * | 12/2012 | Purdy et al. | 5/644 |
| 2014/0230154 | A1 | * | 8/2014 | Palumbo | 5/706 |

* cited by examiner

Section View A—A

METHOD AND DEVICE FOR AGITATING A GROUPING OF CUSHIONING ARTICLES

CROSS REFERENCE TO RELATED APPLICATIONS

This application is the National Stage entry under 35 U.S.C. §371 of PCT Application No. PCT/US2013/025462 filed Feb. 9, 2013, which claims the benefit of U.S. Provisional Patent Application No. 61/597,261 filed Feb. 10, 2012, the contents of which are hereby incorporated by reference in their entirety.

BACKGROUND

Training for gymnastics, extreme sports, and other activities that cause the human body to fall for extended distances can be extremely dangerous. Every year thousands of children and adults suffer injuries during gymnastics and extreme sports training activities. Some of these injuries occur while practicing or learning skills using a foam-landing pit.

A foam-landing pit may be a collection of regularly and/or irregularly shaped foam pieces that are contained within the confines of a structure. The foam pieces may act as cushioning articles for individuals and objects that impact the pit. These structures may be located in the ground, level with the sports apparatus, and/or above the ground.

One of the most frequently occurring injuries associated with foam landing pit is a direct result from the compaction of the foam pieces due to repeated landings. For example, repeated landings may compress and pack the foam, lessening its ability to absorb impacts over a sufficiently long time or distance so as to prevent injury. The packed foam may reduce the amount of air space in-between the foam structure. The reduced air space may result in a more solid surface where deflection is minimized and the impact force of the landing is maximized. Hence, a person landing on compacted foam may have a much higher probability of injury since a larger impact force is imparted on the person during the landing when the foam is compacted.

SUMMARY OF THE INVENTION

Disclosed herein are methods and devices for agitating a plurality of cushioning articles, such as foam pieces included in a landing pit. For example, the device may include an inflatable bladder. The inflatable bladder, when deflated, may be positioned along at least one of a bottom of an enclosure or a side of the enclosure. The enclosure may be open along at least one side. One or more inflatable extensions may be operably coupled to the inflatable bladder. A blower connection may be operably coupled to at least one of the inflatable bladder or the one or more inflatable extensions. Upon applying air to inflate the inflatable bladder and the one or more inflatable extensions via the blower connection at least one of the inflatable bladder or the inflatable extensions may contact a plurality of cushioning articles resulting in decompression of the plurality of cushioning articles.

In an example, the inflatable bladder may be comprised of a plurality of sections. For example, the plurality of sections may be operably coupled to each other via seams and/or internal baffles. When inflated, the inflatable bladder and the one or more inflatable extensions may occupy at least fifty percent of a volume of the enclosure, although other proportions may be utilized. The inflatable extensions may be configured to inflate after the inflatable bladder has been inflated. The device may also include an air release valve that deflates the inflatable bladder and one or more inflatable extensions when opened. In an example, the plurality of cushioning articles may be a plurality of foam pieces. Upon applying the air to inflate the inflatable bladder and the one or more inflatable extensions, at least one of the plurality of cushioning articles may be lifted outside of the enclosure. To ensure the foam articles near the edge of the enclosure are decompressed, the inflatable bladder may be vaulted along sides of the enclosure such that, when inflated, the inflatable bladder extends further from the bottom of the enclosure along the sides of the enclosure than the inflatable bladder extends along the center of the enclosure.

Methods for decompressing foam pieces contained within a landing pit are disclosed. For example, an example method for decompressing the foam pieces may include applying compressed air to inflate an inflatable bladder located at a bottom of the landing pit. The method may also include the inflatable bladder contacting a subset of a plurality of foam pieces contained within the landing pit. The contact may result in at least a portion of the plurality of foam pieces increasing in separation from other foam pieces within the landing pit. As a result, at least the portion of the plurality of foam pieces may be decompressed.

The one or more inflatable extensions may be shaped in a variety of ways. For example, they may be uniformly shaped or non-uniformly shaped. Example shapes for the inflatable extensions may include one or more a triangular prism, a pyramid, a cube, a rectangular prism, a cylinder, a polygonal prism, a cone, a semi-spheres, a hemi-sphere, and/or another three dimensional shape. The method for decompressing the foam pieces may include applying a release valve to deflate the inflatable bladder after the inflatable bladder has been inflated. The inflatable bladder may be shaped to fit a shape of the landing pit.

A device may be configured to decompress foam pieces that are contained within a landing pit. For example, the device may include an inflatable bladder. The inflatable bladder may be positioned along a bottom of the landing pit when deflated. The device may include an air intake device coupled to the inflatable bladder. For example, upon applying compressed air to the air intake device the inflatable bladder may be inflated, resulting in the inflatable bladder occupying at least a portion of the landing pit and displacing at least a subset of foam pieces located within the landing pit. Displacing at least the subset of foam pieces located within the landing pit may result in the decompressions of a plurality of foam pieces within the landing pit.

The device may also include one or more inflatable extensions that are operably coupled to the inflatable bladder and that are also inflated upon applying compressed air to the air intake device the inflatable bladder. The inflatable bladder may be divided into a plurality of sections that are separated by internal baffles. The device may also include an air release valve configured to deflate the inflatable bladder when opened. In an example, the inflatable bladder may be configured to inflate in at least two stages. For example, an inflation rate of a first stage may be faster than an inflation rate of a second stage. As such, although both the first stage and the second stage may begin inflation at approximately the same time, the first stage may complete inflation prior to the second stage due to the varying rates of inflation.

BRIEF DESCRIPTION OF THE DRAWINGS

The following detailed description of disclosed embodiments is better understood when read in conjunction with the appended drawings. For the purposes of illustration, there is shown in the drawings exemplary embodiments; however, the subject matter is not limited to the specific elements and instrumentalities disclosed. In the drawings.

DETAILED DESCRIPTION

Figure 1:
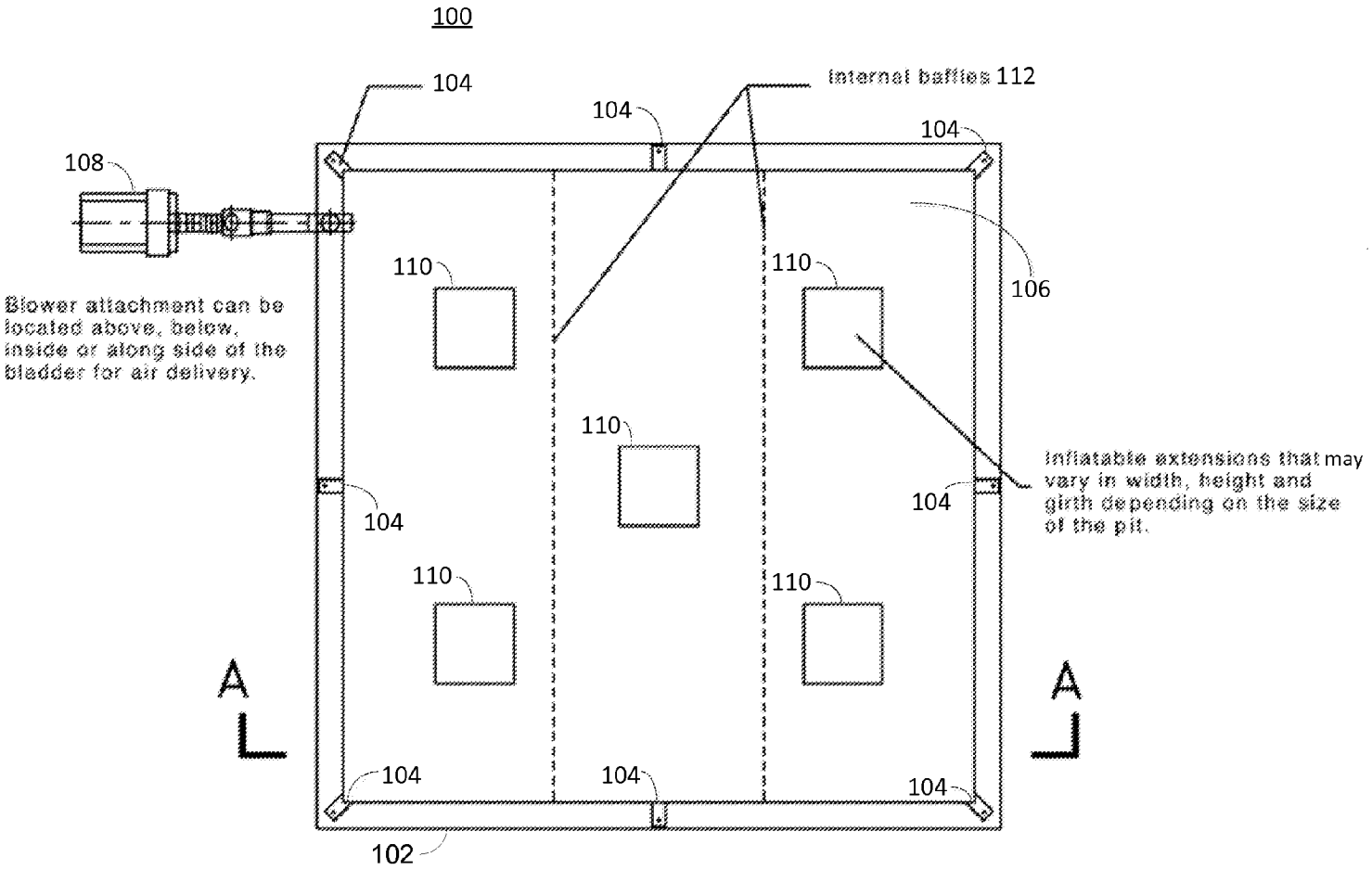
FIG. 1 is a top view of an example agitation device.

A method and device for agitating a grouping of cushioning articles within a receptacle or container are disclosed. The device may include an air pumping device operable to inflate a bladder or other inflatable member located within the container that is adjacent to the grouping of cushioning devices. The inflatable member may comprise a plurality of individual inflatable arm members, which when inflated extend throughout the container in order to increase the spacing of the cushioning articles.

Such systems may be designed to provide foam agitation is such a way so as to provide maximum random and irregular placement of the foam and introduce more air-space in-between the cushioning articles (e.g., foam pieces). The system may accomplish this task in a short period of time as the athletes are generally limited by the amount of time they can spend training specific skills.

The methods described herein may be based on providing appropriate foam pit agitators to decompress cushioning articles, which may vary in size and shape depending on the size and structure of the pit. An air feed tube may be located at the top or bottom of the pit, thereby allowing a stream of air to be injected into the bladder at one or more various positions in order to agitate the foam.

The present disclosure generally relates generally to safety devices and to safety devices and methods for use in Gymnastics, Extreme Sports and other activities. However, the methods and devices described herein are not limited to such example embodiments, and other uses may fall within the scope of this disclosure. For purposes of illustration, this disclosure may describe examples related to gymnastics and foam landing pits, however, one skilled in the art may appreciate how the methods and devices described herein may be implemented in other fields of use.

An advantage of a more distributed and agitated foam landing pit may be its ability to absorb awkward and unplanned landings. This may be accomplished by allowing the athlete or object to pass through several feet and/or many layers of randomly agitated foam pieces that absorb the impact of the athlete. In this scenario, when the athlete falls into the pit, even head first, the uncompressed foam may bring him to a stop relatively slowly. Such a landing produces an impact within the tolerable range of the human body. Landings into foam pits may, over repeated use and time, cause the foam to compress as much as 50%, thus greatly enhancing the opportunity for injury.

The most dangerous fall is where an athlete falls on his or her head. Such falls can cause serious spinal injury and may even be fatal. Falls on the shoulder side or the back are less dangerous but may cause serious soft tissue damage, bone fracture and/or joint dislocation. Uncontrollable foot landing is usually least dangerous with the most probable short-term injuries being those of the knee or ankle due to twisting of the foot and or the knee joints.

One method for foam pit agitation may be to have the individual manually agitate the foam in the pit by inserting a long stick (or the like) in to the cushioning devices in order to pry them apart. For example, in an attempt to separate the pieces, an individual may use the sidewalls as a lever in conjunction with the stick. Another example method may be to have individuals enter the pit and manually agitate the pieces; however, manual agitation often produces inferior results because the pit may become more condensed from the individuals movements and presence within the pit.

In another example, all the pieces from the pit may be manually removed, and once removed, they may be replaced them into the same space. This may result in a much less condensed level of foam then when the agitation process began and achieve the desired level of randomly agitated foam pieces. For example, the air-space in-between may provide for a safer landing experience, lessening the possibility of injury. However, removing all of the foam pieces/cushioning devices may be extremely time consuming and impracticable for many situations and circumstances.

A method and device for agitating a grouping of cushioning articles within a receptacle or container are disclosed. The device may include an air pumping device operable to inflate a bladder or other inflatable member located within the container that is adjacent to the grouping of cushioning devices. The inflatable member may comprise a plurality of individual inflatable arm members, which when inflated extend throughout the container in order to increase the spacing of the cushioning articles.

Such systems may be designed to provide foam agitation is such a way so as to provide maximum random and irregular placement of the foam and introduce more air-space in-between the cushioning articles (e.g., foam pieces). The system may accomplish this task in a short period of time as the athletes are generally limited by the amount of time they can spend training specific skills.

Various sizes, types, and makes of cushioning articles may be utilized in order to absorb impacts. For example, the cushioning articles may be pieces of foam within a foam pit. The cushioning article may be formed by any substance which traps pockets of gas within its structure. The volume of gas within an uncompressed cushioning article may be large relative to volume of solid material separating the regions of gas. In an example, the cushioning devices may be open-cell foams or reticulated foams (e.g., very porous, and gas may enter and exit the foam via the pores). Open-cell-structured foams may contain pores that are connected to each other and form an interconnected network that is relatively soft. Foam rubber is an example of open-cell foam. However, the cushioning devices are not limited to open-cell foams and may also include closed-cell foams (e.g., the gas may form discrete pockets and each pocket may be completely surrounded by the solid material).

When used herein, the term foam may also refer to any material that is analogous to a foam, such as quantum foam, polyurethane foam (e.g., foam rubber), extruded polystyrene (XPS) foam, Polystyrene, phenolic, and/or many other manufactured foams. Typically, foams have relatively low densities as compared to other fully solid materials due to their porous nature. Foam may be compressed, thus removing or eliminating a portion or all of the spacing between the solid structures of the foam. Such compression may be used to absorb impact of kinetic bodies, such as a person falling into a foam pit. Pieces of foam may be formed in various shapes and sizes, and typically an assortment of sizes may be used in a foam pit. The sizes and/or shapes of the foam may be random and/or uncorrelated. Examples of a cushioning material that may be equivalent to foam are pillows or other cushioning devices made of fabric. A cushioning article may be any article capable of being compressed in order to absorb kinetic energy of an object.

To create a safety device designed to absorb kinetic energy from a fast moving (and/or falling) person or device, a plurality of cushioning articles (e.g., foam pieces) may be placed in a pit or enclosure. When the person or device contacts the foam pieces, they may be compressed. The compression may absorb or transfer kinetic energy from the person, thereby allowing the person to be quickly but safely decelerated. However, if the foam is continually depressed, pieces may become overly compressed, thus preventing them from absorbing the kinetic energy over a sufficient time period so as to allow for a safe deceleration. In this case, the person may be decelerated to quickly, resulting in a large impact force that may cause injury to one or more body parts.

In order to decompress foam or other cushioning materials that have become overly compressed, a method and/or device may be utilized in order to agitate the foam members in such a way that the foam is once again able to decelerate and individual or object in safe fashion. FIG. 1 illustrates a top view of an example agitation device 100. As shown in FIG. 1, a foam pit (and/or some other container of cushioning articles) may include outer container 102 for holding the foam pieces. The container may be any shape, although it is shown as a square in FIG. 1. Outer container 102 may be built into the ground and/or be contained partially or completely above ground. Agitation device 100 may be built into the foam pit itself and/or may be attached to an existing foam pit. For example, the agitation device 100 may include one or more tabs 104 to secure agitation device 100 to the bottom or sides of the enclosure. Tabs 104 may be any mechanism that allows the bladder/agitation device to be fixed to the pit. For example, tabs 104 may be include buttons, Velcro, strings, glue, ties, and/or any other structure capable of attaching the bladder/agitation device to the pit.

Agitation device 100 may include inflatable bladder 106. The inflatable bladder may be located at the bottom of the enclosure. Inflatable bladder 106 may be located within one or more sides of the enclosure. For example, inflatable bladder 106—when deflated—may extend along the some or all of the bottom of the pit. Inflatable bladder 106 may extend to each of the walls of outer container 102. The edges of inflatable bladder 106 may be vaulted, for example to ensure proper decompression of foam pieces along the enclosure wall and/or side of the pit. Tabs 104 may be affixed to secure inflatable bladder 106 to the bottom and/or sides of the enclosure. When the inflatable bladder 106 is not inflated, inflatable bladder 106 may occupy a relatively small portion of the volume of the enclosure. For example, when not inflated inflatable bladder 106 may lay upon the floor of the pit. When inflated, inflatable bladder 106 may occupy a relatively substantial portion of the enclosure. Inflatable bladder 106 may be configured to inflate across the entire bottom of the enclosure. Inflatable bladder 106, when inflated, may raise most or all of the foam pieces a specified distance above the bottom of the enclosure. As an example, when inflated, inflatable bladder 106 may extend to a height of 50% or more of the height of the enclosure.

In order to achieve a desired amount of foam agitation, inflatable bladder 106 may be configured to inflate in order occupy desired portion of the volume of the enclosure. In an example, the amount of volume occupied by the bladder when inflated may be selected based on the type of material or foam included in the pit, the current level of compression of the material or foam included in the pit, and/or the current amount of volume occupied by the material or foam included in the pit. For example, in order to achieve a desired level of agitation, when inflated inflatable bladder 106 may be configured to occupy at least 50% of the volume of the pit (e.g., including or not including any additional arms that extend from the main body of the bladder). By occupying at least 50% of the volume of the container, the foam may be agitated in a sufficient manner so that they will reach a desired level of decompression.

Inflatable bladder 106 may be filled with compressed air. Inflatable bladder 106 may be filled with any type of gas. Inflatable bladder 106 may be filled with any type of material that allows it to be inflated and deflated. For example, inflatable bladder 106 may be filled with compressed air. The source of the compressed air may be an air compressor. Agitation device 100 may include blower attachment 108. Blower attachment 108 may be a connector designed to connect the bladder to a source of air or gas. Blower attachment 108 may be located above, below, inside, and/or alongside inflatable bladder 106. There may be more than one blower attachment 108 connecting to inflatable bladder 106, although a single attachment is shown in the example illustrated in FIG. 1. When a gas source is operably coupled to agitation device 100 via blower attachment 108, gas/air may be inserted into inflatable bladder 106. Inflatable bladder 106 may become inflated. The blower unit/air source may provide a high volume of air that is adequate to lift and decompress (agitate) the cushioning articles contained in the pit (enclosure).

Inflatable bladder 106 may include one or more inflatable extensions 110. Inflatable extensions 110 may vary in width, height, and/or girth. For example, the size and/or shape of inflatable extensions 110 may depend on the size of the enclosure, the dimensions of the enclosure, the type of foam/cushioning articles, the size of the foam/cushioning articles, and/or of the use of foam pit. In an example, the size and/or shape of the inflatable extensions 110 may depend on the size, shape, and/or number of foam pieces with the foam pit. For purposes of illustration, FIG. 1 shows five inflatable extensions 110. In the example shown in FIG. 1, inflatable bladder 106 may be located at the bottom of the enclosure and inflatable extensions 110 may extend upward from the main portion of inflatable bladder 106. When inflated, inflatable extensions 110 may extend into the plurality of foam pieces. Inflatable extensions 110 may be configured to add increased spacing between the individual foam pieces. Inflatable extensions 110 may be configured to laterally separate two or more foam pieces.

Agitation device 100 may include one or more internal baffles 112. Internal baffles 112 may be configured to direct air flow within inflatable bladder 106. For example, internal baffles 112 may be configured to direct the flow of gas/air within inflatable bladder 106 and/or inflatable extensions 110. The baffles may be configured in such a way as to allow inflatable bladder 106 and inflatable extensions 110 to be inflated quickly and/or uniformly. In an example, inflatable bladder 106 may be divided into sections (e.g., longitudinal sections) in order to facilitate inflation. Each section may be joined using seams. Internal baffles 112 may be used to internally divide sections of inflatable bladder 106.

Although inflatable bladder 106 is shown to be divided into three longitudinal sections in FIG. 1, greater or few sections may be used. For example, the sections may be irregularly shaped and/or non-uniform in nature. This may be the case if the agitation device is used with an irregularly shaped landing pit. The several sections of the inflatable bladder may be separated by the internal baffles.

In an example, although not shown in FIG. 1, one or more inflatable extensions may extend from another inflatable extension. For example, a first inflatable extension may extend from an inflatable bladder (e.g., perpendicularly or nearly so), and a second inflatable extension may extend from the first inflatable extension. For example, the second inflatable extension may extend perpendicularly (or nearly so) from the first inflatable extension. In an example, one or more secondary inflatable extensions may be configured to extend from a primary inflatable extension (e.g., an inflatable extension that extends from the base inflatable bladder) at various angles from a given face of the primary inflatable extensions. For example, a first secondary inflatable extension may extend at a first angle from a face of a primary inflatable extension, and a second secondary inflatable extension may be configured to extend from the face of the primary inflatable extension at a second angle. Similarly, the two or more primary inflatable extensions may extend from a face of the inflatable bladder at different angles. Such regular and/or irregular inflatable extension angles may facilitate the agitation of the foam articles. As may be appreciated, additional "branches" or layers of inflatable extensions (e.g., tertiary inflatable extensions, etc.) may be utilized. Internal baffles may be used to separate an inflatable extension from the inflatable bladder, a primary inflatable extension from a secondary inflatable extension, etc.

Figure 2:
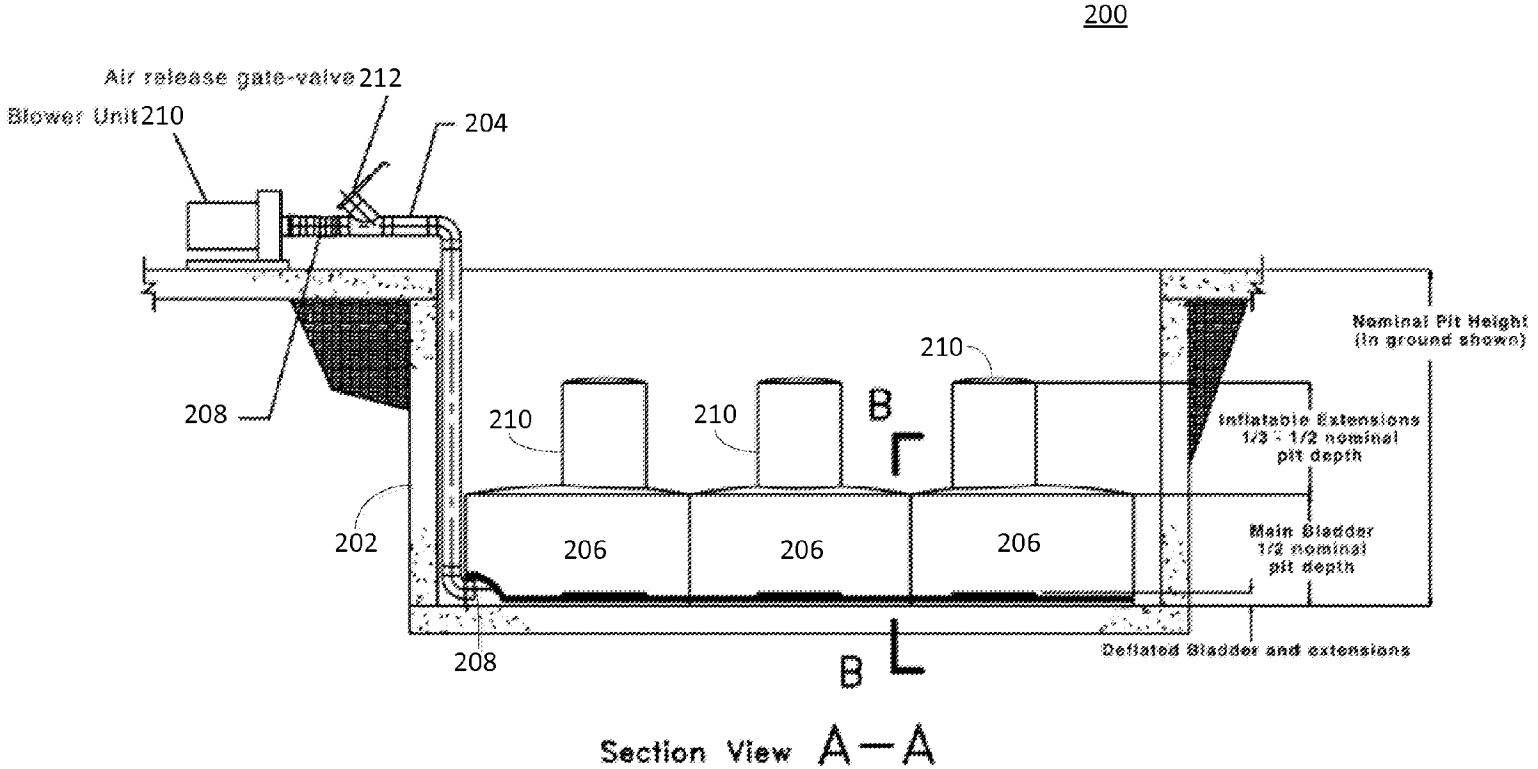
FIG. 2 is a sectional view of an example agitation device.

FIG. 2 is an example sectional view of an example agitation device 200. As shown in FIG. 2, agitation device 200 may be located at the bottom of the foam pit enclosure 202. When deflated, inflatable bladder 206 and inflatable extensions 210 may occupy a relatively small portion of the enclosure. Inflatable bladder 206 may be connected to air delivery mechanism 204 (e.g., a tube, pipe and/or hose), for example via blower attachment 208. A second blower attachment 208 may also connect air delivery mechanism 204 to blower unit 210. Air delivery mechanism 204 may be rigid or flexible duct work. Air delivery mechanism 204 and/or any blower attachment 208 may be operably coupled to air release gate-valve 212. Air release-gate valve 212 may be configured to quickly remove the air from inflatable bladder 106 and/or inflatable extensions 110. In an example, air release gate-valve 212 may be connected directly to inflatable bladder 206. Air delivery mechanism 204 may also be operable connected to blower attachment 208 in order to receive air from blower unit 210. Blower unit 210 may be a source of compressed air for inflating inflatable bladder 106 and/or inflatable extensions 110. Blower attachment 208 may be located above, below, inside and/or alongside of inflatable bladder 106 for air delivery.

When engaged, blower unit 210 may force compressed air into air delivery mechanism 204, which directs the air into inflatable bladder 106. As the air is forced into agitation device 200, inflatable bladder 106 and/or inflatable extensions 110 may increase in volume. As the volume of air within the inflatable bladder 106 and/or inflatable extensions 110 is increased, the pieces of foam may be perturbed and separated. For example, the foam pieces may be forced towards the top of the enclosure. When inflatable bladder 106 and/or inflatable extensions 110 are deflated, the foam may resettle within the enclosure. The foam may be uncompressed during this process. The volume of the portion of the container occupied by the foam may be increased as compared to the volume of the portion of the container occupied by the foam prior to inflating the bladder. Due to decompression of the foam caused by the agitation device, the volume of space within the enclosure that is occupied by the foam may increase.

As shown in FIG. 2, when inflatable bladder 106 and/or inflatable extensions 110 are fully inflated, they may occupy a great deal more space/volume as compared to they are deflated. For example, when inflated, the main portion of inflatable bladder 106 may occupy approximately half the nominal height of the enclosure. Inflatable extensions 110 may occupy approximately another half to one third of the nominal height of the enclosure. These dimensions are exemplary and other dimensions may also be used. For example, the inflatable extensions may be non-uniformly shaped, and a first inflatable extension may be a different size than a second inflatable extension. The inflatable extensions may be different shapes from one another. In another example, each of the inflatable extensions may be uniformly sized and/or spaced.

Figure 3:
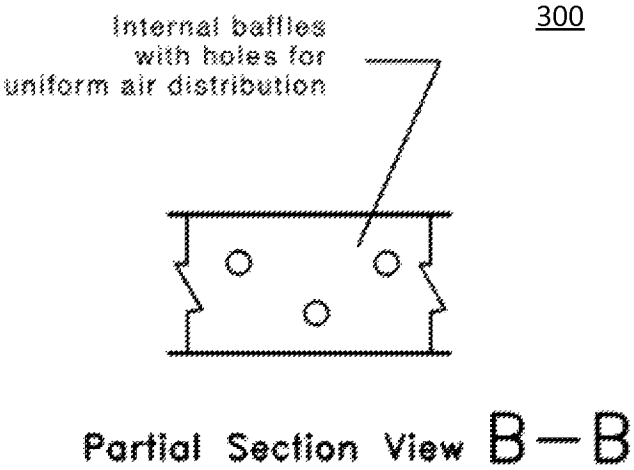
FIG. 3 is a partial section view of an example internal baffle.

FIG. 3 is an example of a partial sectional view of internal baffle 300. The internal baffles may be placed within the inflatable bladder and/or within the inflatable extensions in order to provide for uniform air distribution. For example, the internal baffle may comprise a plurality of holes for uniform air distribution. Internal baffles may also be designed such that the inflatable bladder and/or the inflatable extensions inflate in stages and/or in a specified order. The used to form the baffles may be uniformly shaped and/or spaced or be non-uniformly shaped and/or spaced. The holes may be configured to uniformly space the air within the bladder and/or inflatable extensions.

Figure 4:
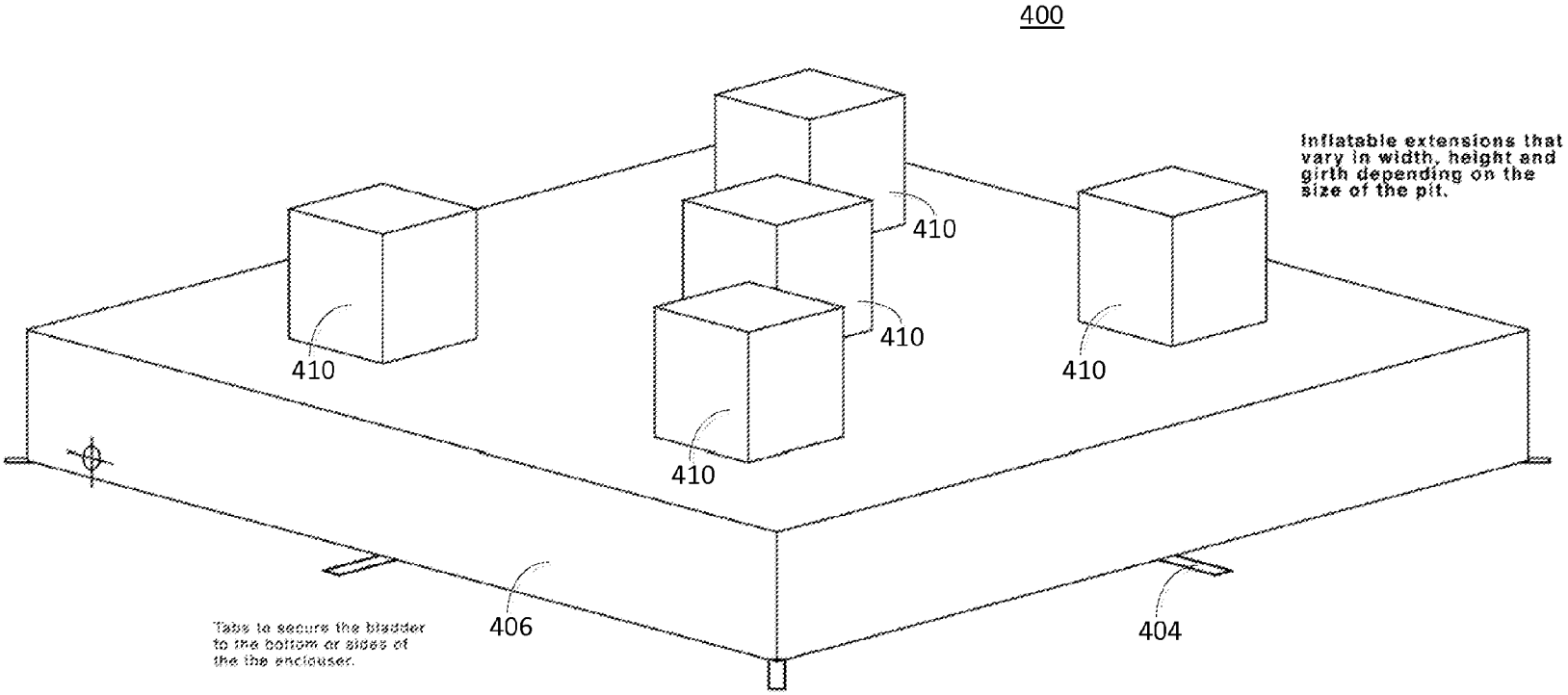
FIG. 4 is an example of an inflatable foam pit agitation device.

FIG. 4 illustrates an example agitation device 400. As shown in FIG. 4, inflatable bladder 406 and inflatable extensions 410 may be filled with gas and/or air to create the shape shown. Although inflatable extensions 410 shown in FIG. 4 have uniform dimensions and spacing, one or more of the inflatable extensions may vary in size and/or spacing from the other inflatable extensions. The width, height, and/or girth of inflatable extensions 410 may be varied based on the size and/or shape of the foam pit enclosure. Inflatable bladder 406 may be operably coupled to one or more tabs or connectors 404 to secure inflatable bladder to the bottom or side of the enclosure.

Figure 5:
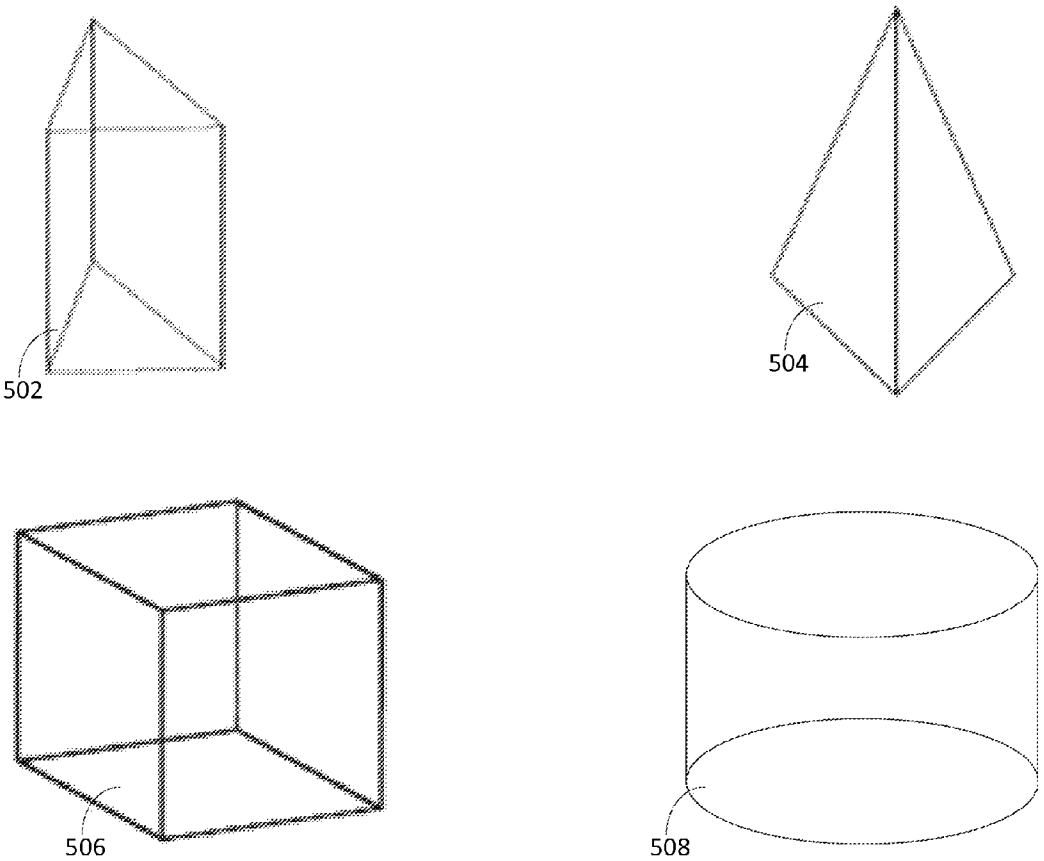
FIG. 5 illustrates example shapes of the inflatable extensions that may be attached to the inflatable bladder.

FIG. 5 illustrates several examples of shapes that may be used for the inflatable extensions. For example, as illustrated in FIG. 5, an inflatable extension may take the form of inflatable extension 502, which may form a triangular prism. In an example, an inflatable extension make take the form of inflatable extension 504, which may be a pyramid. Although a pyramid with a triangular base is shown in FIG. 5, a pyramid with another type of base (e.g., square, rectangle, pentagon, other polygons, etc.) may be used. In another example, inflatable extensions may take the form of inflatable extension 506, which may be a cube or rectangular prism. In another example, inflatable extensions may take the form of inflatable extension 508, which may be a cylinder. Other example shapes for the inflatable extensions may include other types of polygonal prisms, cones, semi-spheres, hemi-spheres, non- or irregularly shaped three dimensional objects, and/or combinations of multiple three dimensional shapes.

For example, a first rectangular prism (e.g., or some other three dimensional shape) may for the first leg of an inflatable extension. A second rectangular prism (e.g., or some other three dimensional shape), may extend from the end of the first rectangular prism, for example in a different direction than the first rectangular prism extended from the inflatable bladder. Such extensions off the inflatable extensions may be designed or chosen based on the shape of the inflatable pit. For example, for irregularly shaped pits, the extensions of the extensions may be designed to agitate foam pieces in sections of the pit that are far from the inflatable bladder. Baffles may be inserted between the different sections of the inflatable extensions to ensure uniform air circulation and/or ensure that the second inflatable extension is filled after the first section of the inflatable extension has already completely inflated or has inflated a majority of its possible volume (e.g., the sections of inflatable extensions may be inflated in stages).

Figure 6:
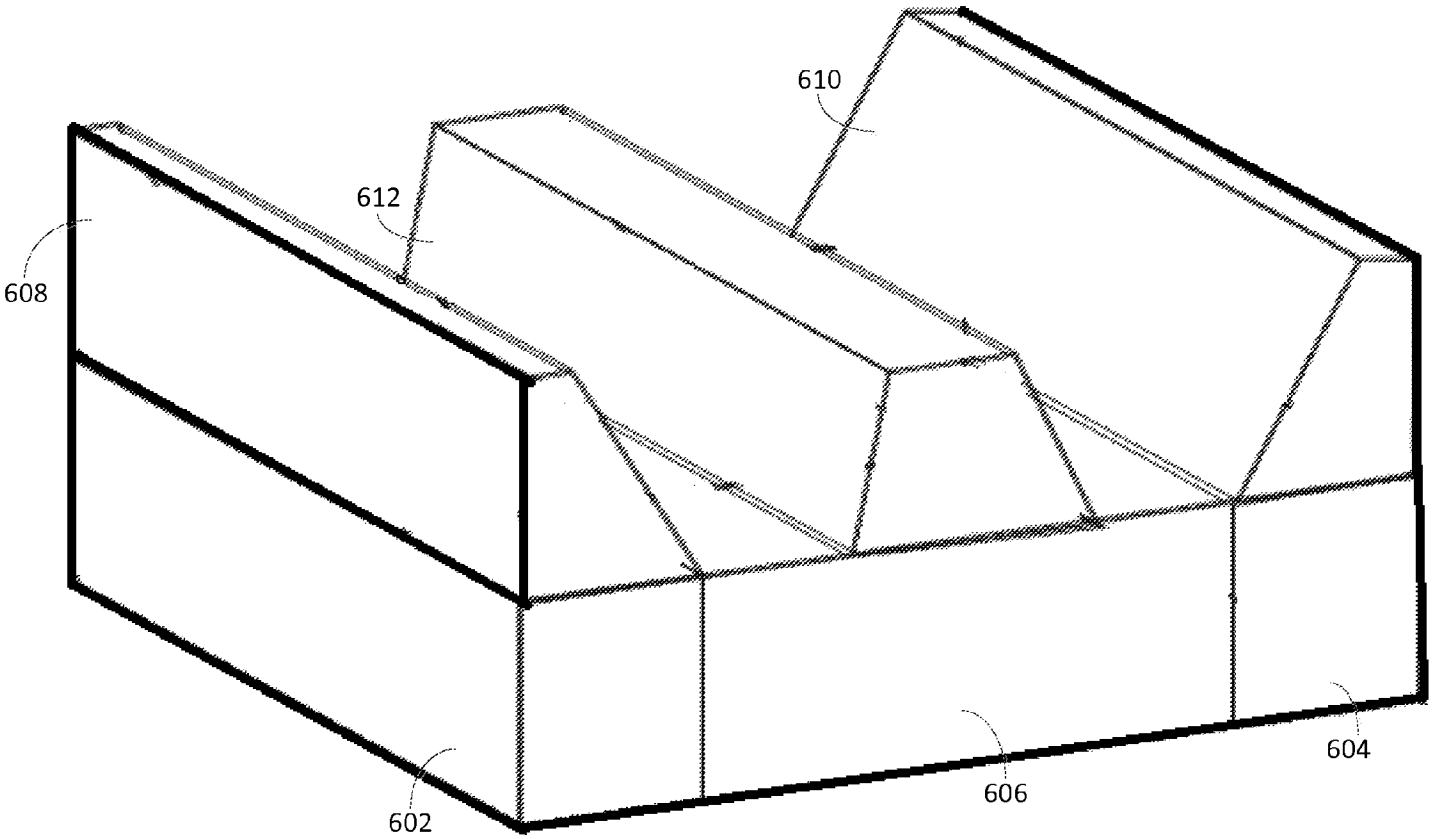
FIG. 6 illustrates another example of an agitation device.

In an example, the inflatable bladder (and/or portions thereof) and/or the inflatable extensions (and/or portions thereof) may be designed to be inflated in stages in order to achieve increased agitation of the foam pieces. For example, FIG. 6 illustrates an example wherein bladder section 602 and bladder section 604 may be inflated prior to inflation of bladder section 606. Thus, a first stage of the inflation may include the inflation of bladder section 602 and bladder section 604 (e.g., the outer edges at inflated first). Once bladder section 602 and bladder section 604 have been inflated, bladder section 606 may be inflated. Inflating the bladder sections in stages and/or inflating the inflatable extensions (e.g., inflatable extension 608, inflatable extension 610, inflatable extension 612, etc.) in stages may facilitate a more optimized and/or faster decompression of the foam pieces.

For example, the agitation device may be configured to first inflate bladder sections close to one or more edges of the pit (e.g., bladder section 602, bladder section 604), followed by the extensions that are connected to the bladder sections near the outside edge (e.g., inflatable extension 608, inflatable extension 610). The sections to inflate first may be selected to be the sections closest to two opposite edges of the agitations device. For larger pits, the first sections to be inflated may be any section that is adjacent to a wall or edge of the pit. In a further stage, the interior sections of the bladder may be inflated (e.g., bladder section 606), followed by any inflatable extensions attached to these inner sections (e.g., inflatable extension 612).

In another example, each of the sections of the inflatable bladder may be inflated first (perhaps in a specified order), followed by the inflatable extensions (perhaps in a specified order). For example with reference to FIG. 6, in a first stage, bladder section 602 and bladder section 604 may be inflated. In a second stage, bladder section 606 may be inflated. In a third stage, inflatable extension 608 and inflatable extension 610 (e.g., the inflatable extensions corresponding to the bladder sections inflated in stage 1) may be inflated. In a fourth stage, inflatable extension 612 (e.g., the inflatable extensions corresponding to the bladder sections inflated in stage 2) may be inflated.

In another example, certain sections of the inflatable bladder (such as one or more of the edge sections) may be inflated first (e.g., bladder section 602 and bladder section 604) followed by the inflatable arms for those bladder sections (e.g., inflatable extension 608 and inflatable extension 610). In an example, rather than inflating the bladder section before the inflatable extensions, the bladder section and their corresponding inflatable extensions (e.g., bladder section 602, bladder section 604, inflatable extension 608, and inflatable extension 610) may be inflated together in a first stage.

Once the bladder sections and inflatable extensions of the first stage have been inflated, the bladder section(s) and/or the inflatable extensions of the second stage (e.g., bladder section 606, inflatable extension 612) may be inflated. For example, the bladder section(s) and the inflatable extensions of the second stage may be inflated together (e.g., substantially simultaneously) or they may be inflated in sub-stages. For example, the bladder section may be inflated first, followed by the inflatable extension. In an example, the inflatable extensions may be inflated first, followed by the bladder sections (e.g., in some or all of the inflation stages).

Figure 7:
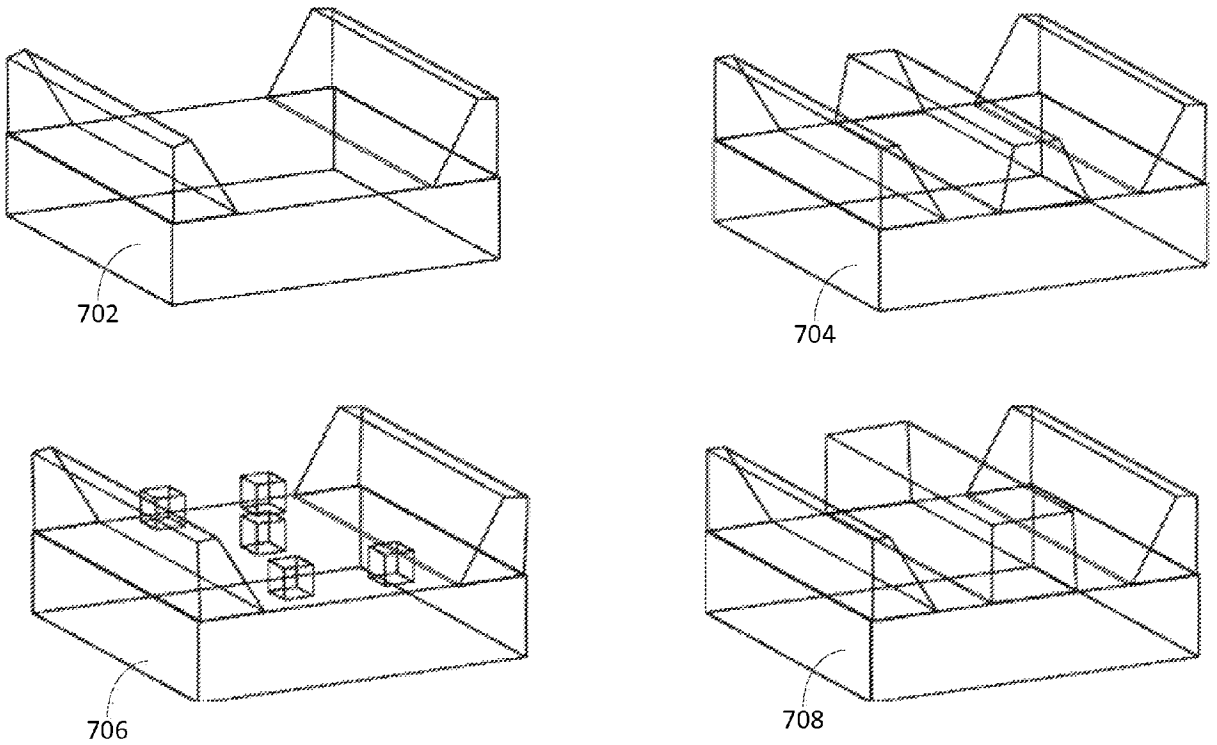
FIG. 7 illustrates various arrangements of the inflatable extensions for the agitation device.

FIG. 7 illustrates various example arrangements for the inflatable bladder and inflatable extension sections of agitation devices. Although the bladder in each of the examples illustrated in FIG. 7 (e.g., agitation device 702, agitation device 704, agitation device 706, agitation device 708) is shown as a single section, in some examples these bladders may also be divided into sections, for example for inflation in specified stages.

For example, as illustrated in FIG. 7, agitation device 702 may include a single inflatable bladder section and two side inflatable wedges as inflatable extensions. The wedges may be positioned at opposite ends of the bladder. In an example, agitation device 704 may include an inflatable bladder section, two side inflatable wedges as inflatable extensions, and an inflatable finger section across a middle section of the bladder. In an example, agitation device 706 may include an inflatable bladder section, two side inflatable wedges as inflatable extensions, and a plurality of polygonal prism inflatable extensions in the middle section of the bladder. In another example, agitation device 708 may include an inflatable bladder section, two side inflatable wedges as inflatable extensions, and an inflatable finger section across a middle section of the bladder, for example in a rectangular prism shape.

The types of extensions or fingers that extend from the main bladder section(s) may be selected based on the type of pit and/or the type of foam. For example, large wedge sections that extend from sections of the bladder near the edge of the pit may be designed to prevent some or all of the foam pieces from falling out of the pit as the agitation device is inflated. In an example, long, thinner extensions may be designed to separate the foam once the bladder has partially inflated, thus displacing the foam from the bottom of the pit (e.g., there may be more room to separate individual foam pieces once some of the foam pieces have been push outside or above the confines of the enclosure). This may also be a justification for inflating different sections of the agitation device in stages, as once some of the foam pieces have been pushed outside the containment (e.g., above the pit), the later stages may have increased success in separating the foam pieces.

Figure 8:
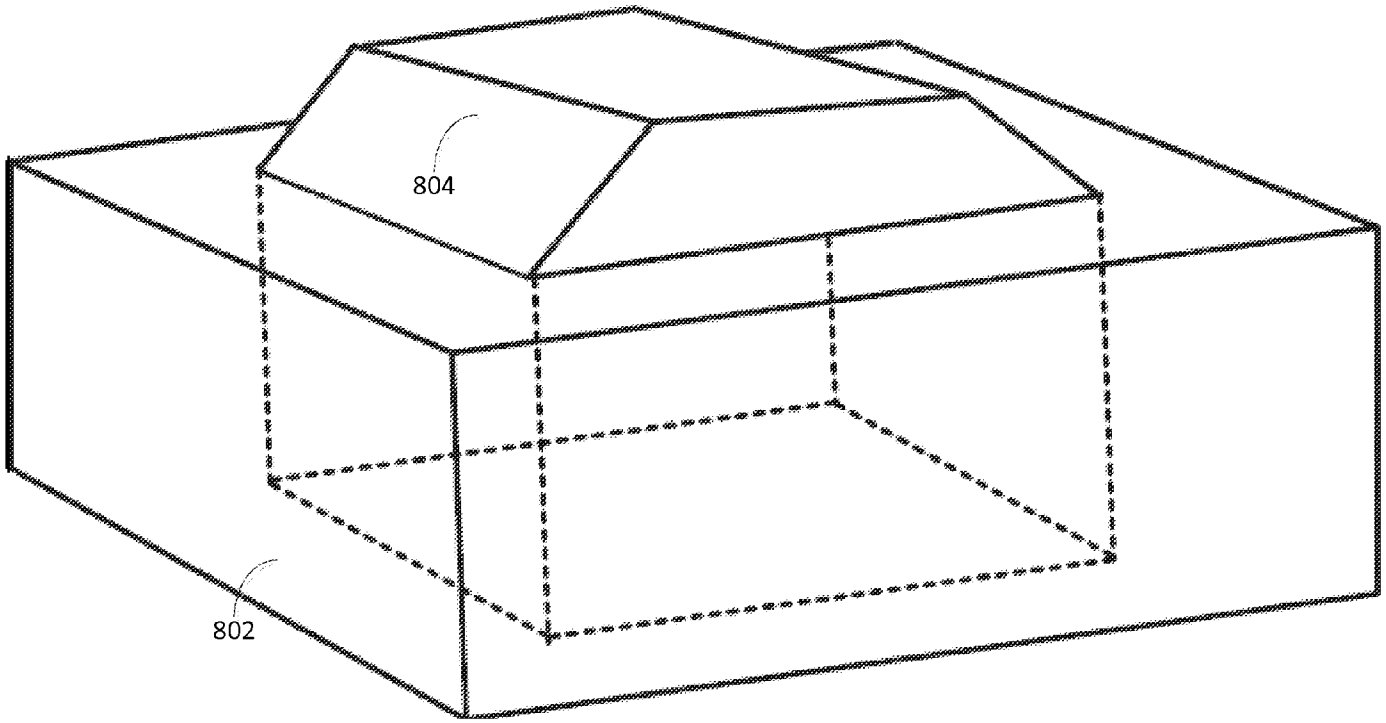
FIG. 8 illustrates an example agitation device where an exterior stage may be inflated prior to a second, interior stage being inflated.

FIG. 8 illustrates an example agitation device where an exterior stage (e.g., near the edges of the enclosure) may be inflated prior to a second, interior stage being inflated. In the example illustrated in FIG. 8, the bladder may be divided into multiple sections (e.g., bladder section 802 and bladder section 804). Upon inflation, bladder section 802, which may be located along the exterior of the inflatable bladder adjacent to the enclosure walls, may inflate in a first stage. In a second stage, bladder section 804 may inflate. In an example, although bladder section 804 may inflate at the same time as bladder section 802, bladder section 804 may inflate at a slower rate than bladder section 802. Such differences in the rate of inflation may result in bladder section 802 inflating prior to bladder section 804. Bladder section 804 may be located in the center of the inflatable bladder and/or may be displaced or away from the edges of the container. Bladder section 804, when inflated, may extend higher than bladder section 802 when inflated. In an example, Bladder section 804 may be one or more inflatable extensions from a main bladder section.

By inflating the center section after the side sections and/or by inflating the center section to a greater height than the sections adjacent to one or more sides of the enclosure, the act of inflating the agitation device may cause the relative position of one or more cushioning articles to be changed, thus facilitating decompression. For example, foam pieces located in the center of the enclosure may be moved towards the perimeter of the enclosure. When the agitation device is then deflated, one or more foam pieces that were previously near the sides of the enclosure may be repositioned closer to the center of the enclosure. The rotation of the relative positions of the foam pieces within the enclosure may facilitate decompression.

Figure 9:
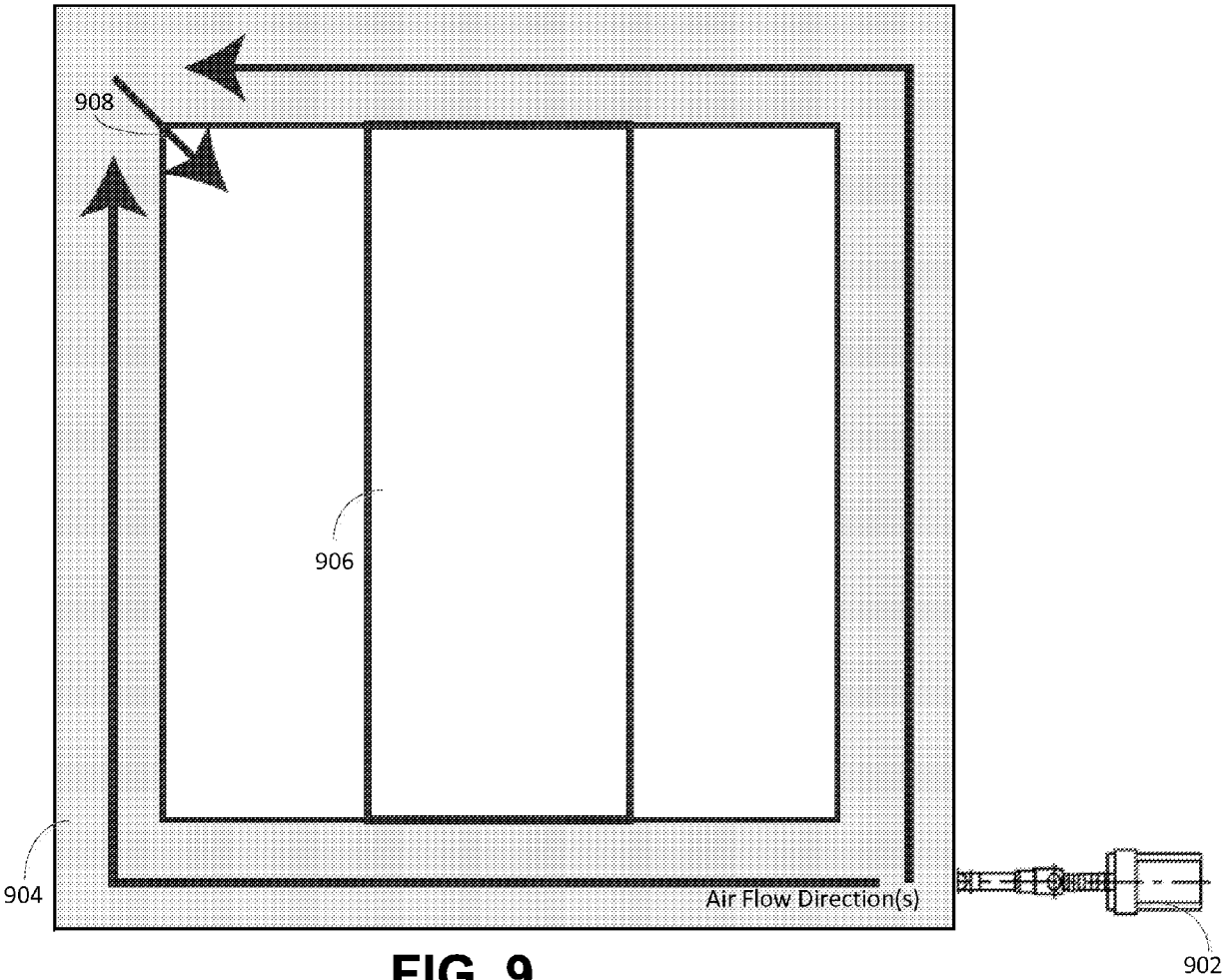
FIG. 9 illustrates an example of an agitation device that is inflated in multiple stages.

FIG. 9 illustrates another example of a multi-stage agitation device (e.g., top view). In the example, illustrated in FIG. 9, Blower 902 may be operably connected to First Stage 904. First Stage 904 may be an inflatable bladder and/or section of an inflatable bladder that lines and/or is adjacent to one or more edges of the enclosure. Upon applying compressed air via Blower 902, First Stage 904 may become inflated. First Stage 904 may be vaulted and/or may have flat sides. Second Stage 906 may be inflated after First Stage 904. For example, Junction 908 may be designed to allow little or no air to enter Second Stage 906 until First Stage 904 has been inflated or nearly inflated. For example, one or more valves may be include in Junction 908 to prevent the air from entering Second Section 906 until First Section 904 has reached or exceed a given volume and/or pressure. In another example, Junction 908 may be a baffle or opening that is designed to limit the amount of air that passes to Second Stage 906, so although some air may enter Second Stage 906 while First Stage 904 is still inflating and/or not yet fully inflated, the amount of leakage may be relatively small, resulting in First Stage 904 inflating at a faster rate than Second Stage 906. As the amount of air within First Stage 904 increases, the pressure of the air within First Stage 904 may increase, thus increasing the air flow through Junction 908 into Second Stage 906. Thus, as First Stage 904 is further inflated, the rate at which Second Stage 906 is inflated may increase.

Although a single Junction 908 is shown in FIG. 9, more than one Junction 908 may be present. The one or more junctions may be located at various intersections between the stages, and the location of the junctions may be selected to facilitate multi-stage inflation. Junction 908 may be positioned at the intersection along the boundary between First Section 904 and Second Section 906 at a location that is at or near the maximum distance away from the location where air enters First Stage 904 from Blower 902. For example, if the enclosure base is a square or rectangle Junction 908 may be positioned at the opposite side/corner as the intake from Blower 902. Such positioning may facilitate the multi-stage operation by causing more air to fill First Stage 904 prior to the inflation of Second Stage 906. Additionally, although two stages are illustrated in FIG. 9, more than two stages may be utilized.

Figure 10:
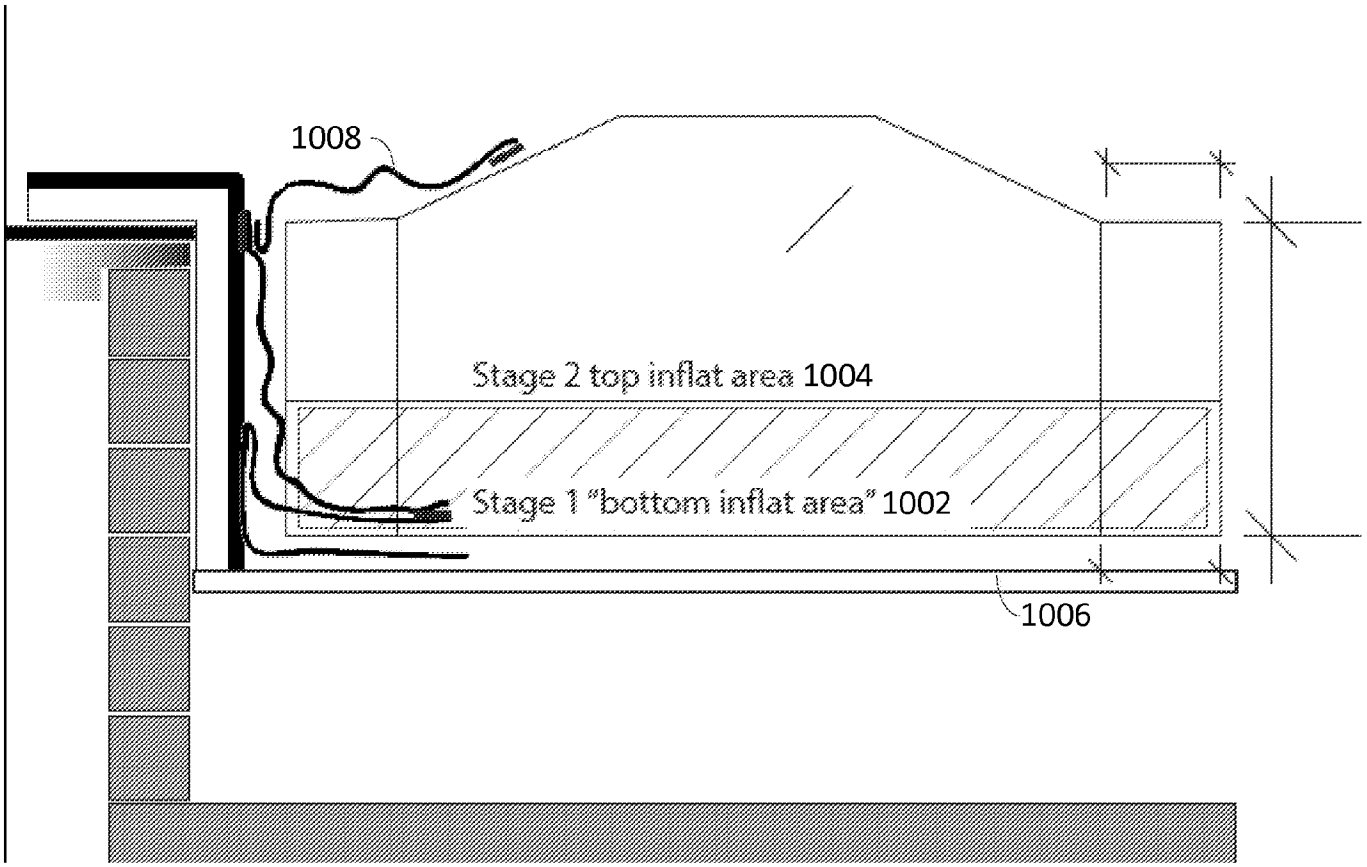
FIG. 10 illustrates another example of an agitation device that is inflated in multiple stages.

FIG. 10 illustrates an example where a first stage is located along the bottom of the pit or enclosure and a second stage is located along the top of the first stage. In an example, First Stage 1002 may be designed to inflate a given height from the bottom of the pit of enclosure. For example, First Stage 1002 may have a base that is the same shape and dimensions as the enclosure. When inflated First Stage 1002 may extend a given distance upward from the bottom of the enclosure. In effect, the inflation of First Stage 1002 may act to raise the height of the bottom of the pit. Thus, First Stage may be designed to effectively reduce the depth of the foam pit. In an example, rather than being located directly along the solid bottom of the enclosure, First Stage 1002 may extend from a trampoline or foam surface, for example Surface 1006 as illustrated in FIG. 10. Such an arrangement may facilitate training for exercises wherein a skill cushion and/or semi-solid surface is used to practice landings. The device may be configured to inflate First Stage 1002, but not Second Stage 1004 until a second valve is opened.

For example, certain training routines may utilized a skirt attachment or landing mat 1008 to simulate landing on ground. Skirt Attachment or landing mat 1008 may be place over and/or on top of loose foam pieces in order to simulate a ground landing while still providing some cushioning to prevent injuries. By inflating First Section 1002 to raise the level of the pit, an athlete practicing landings may be forced to attempt the landing earlier, as he would reach the elevated landing earlier. Such training may help condition athletes to perform the landing earlier in the trick or routine, which may be desirable from a training point of view. In addition to First Stage 1002, Second Stage 1004 may also be inflated, for example, after First Stage 1002 in order to further agitate cushioning articles and/or to further raise the "bottom" of the landing pit.

The agitation device may include one or more of the following components: one or more tabs to secure the bladder to the bottom or sides of the enclosure; an inflatable bladder base, which may extend along the bottom or side of the enclosure; inflatable extensions that may vary in width, height and girth depending on the size/shape of the pit and/or size/shape of the foam pieces; a device to provide a stream of air/gas (e.g., a blower unit); an air stream release gate-valve; a connection between the blower unit and the inflatable device, for example via an air delivery mechanism of rigid or flexible ductwork; one or more internal baffles to maintain the shape of the device when inflated and to facilitate uniform distribution of air; a main bladder, which may include inflatable extensions and internal baffles to be constructed of vinyl coated polyester, canvas and/or the like. Loose stitching of the bladder seams may allow for air seepage preventing the bladder from bursting.

An example process for agitating cushion articles, such as foam pieces, with an enclosure may include applying an air source to an inflatable bladder located on the bottom and/or side of the enclosure. Applying the air source may cause the inflatable bladder and/or one or more inflatable extensions to become inflated. The inflated bladder and/or extensions may display one ore cushioning devices within the pit. The cushioning devices may be uncompressed during the process. The air may be removed from the agitation device including the inflatable bladder and extensions. When the air is removed, the foam pieces may resettle within the enclosure. The foam pieces may be in a less compressed form than at the beginning of the process. The foam pieces may occupy a larger volume within the pit than they occupied at the beginning of the process. The process may be repeated as desired.

Although when described with respect to FIG. 1-10, the agitation devices disclosed herein may take many designs or forms. For example, the inflatable bladder may be attached to the side of a container rather than (or in addition to) the bottom of the container. The extendable inflatable arms may extend horizontally through the container. There may be secondary extendable arms which extend from the primary extendable arms attached to the main bladder portion. The extendable arms may be designed based on the size and shape of the container. The extendable arms may extend in multiple directions and/or a multiple angles from the main bladder portion. Baffles may be located within the extendable arms so as to provide a define shape upon inflation.

The techniques and features described herein may be implemented in any order or combination.

What is claimed:

1. A device for agitating a plurality of cushioning articles, the device comprising:

an inflatable bladder, wherein the inflatable bladder, when deflated, is positioned along at least one of a bottom of an enclosure or a side of the enclosure, and the enclosure is open along at least one side;

one or more inflatable extensions operably coupled to the inflatable bladder; and a blower connection operably coupled to at least one of the inflatable bladder or the one or more inflatable extensions, wherein the blower connection is configured to apply air to the interior of the inflatable bladder and the one or more inflatable extensions such that the inflatable bladder and inflatable extensions increase in volume and the exterior of at least one of the inflatable bladder or the one or more inflatable extensions contacts a plurality of cushioning articles resulting in an increase in spacing between at least two of the plurality of cushioning articles and in decompression of the at least two cushioning articles.

2. The device as in claim 1, further wherein the inflatable bladder is comprised of a plurality of sections, and the plurality of sections are operably coupled to each other via seams and internal baffles.

3. The device as in claim 1, wherein when inflated, the inflatable bladder and the one or more inflatable extensions occupy at least fifty percent of a volume of the enclosure.

4. The device as in claim 1, wherein the one or more inflatable extensions are configured to inflate after the inflatable bladder has been inflated.

5. The device as in claim 1, further comprising an air release valve configured to deflate the inflatable bladder and one or more inflatable extensions when opened.

6. The device as in claim 1, wherein the plurality of cushioning articles comprise a plurality of foam pieces, and decompression of the at least two cushioning articles corresponds to the at least two cushioning articles occupying a larger volume than a volume that the at least two cushioning articles had previously occupied.

7. The device as in claim 1, wherein upon applying the air to inflate the inflatable bladder and the one or more inflatable extensions at least one cushioning article is lifted outside of the enclosure.

8. The device as in claim 1, wherein the inflatable bladder is vaulted along sides of the enclosure such that, when inflated, the inflatable bladder extends further from the bottom of the enclosure along the sides of the enclosure than the inflatable bladder extends along the center of the enclosure.

9. A device for agitating a plurality of cushioning articles, the device comprising:

an inflatable bladder, wherein the inflatable bladder, when deflated, is positioned along at least one of a bottom of an enclosure or a side of the enclosure, and the enclosure is open along at least one side; and a blower connection operably coupled to the inflatable bladder, wherein upon applying air to the interior of the inflatable bladder via the blower connection the inflatable bladder is configured to:

increase in volume such that the inflatable bladder occupies a larger volume in the enclosure, contact via the exterior of the inflatable bladder a plurality of cushioning articles, and displace the plurality of cushioning articles resulting in an increase in spacing between at least two of the plurality of cushioning articles such that the plurality of cushioning articles are decompressed when the inflatable bladder is re-deflated.

10. The device as in claim 9, further comprising one or more inflatable extensions operably coupled to the inflatable bladder, wherein the one or more inflatable extensions are also inflated upon applying the air to inflate the inflatable bladder.

11. The device as in claim 9, wherein the plurality of cushioning articles comprise a plurality of foam pieces.

12. The device as in claim 9, further comprising an air release valve configured to deflate the inflatable bladder when opened.

13. The device as in claim 9, wherein the inflatable bladder is divided into a plurality of sections that are separated by internal baffles.

14. The device as in claim 9, wherein the inflatable bladder is configured to inflate in at least two stages, and an inflation rate of a first stage is faster than an inflation rate of a second stage.

15. A device for decompressing foam pieces, the device comprising:

an inflatable bladder, the inflatable bladder being configured to transition from a deflated state to an inflated state, wherein when in the deflated state the inflatable bladder is configured to be positioned along at least one of a bottom of an enclosure or a side of the enclosure;

a blower connection operably coupled to the inflatable bladder, wherein the blower connection is configured to apply air to the interior of the inflatable bladder in order to transition the inflatable bladder from the deflated state to the inflated state, wherein in the inflated state the inflatable bladder is configured to occupy a larger volume of the enclosure than the inflatable bladder occupies in the deflated state, and the inflatable bladder is configured to displace a plurality of foam pieces during the transition from the deflated state to the inflated state due to the exterior of the inflatable bladder contacting at least a portion of the plurality of foam pieces such that spacing between at least two of the foam pieces is increased.

16. The device as in claim 15, further comprising an air release valve configured to release air from the inflatable bladder in order to transition the inflatable bladder from the inflated state to the deflated state, wherein upon deflation the plurality of foam pieces occupy a larger volume than a volume that the plurality of foam pieces occupied prior to the inflatable bladder transitioning from the deflated state to the inflated state.

17. The device as in claim 15, further comprising one or more inflatable extensions operably coupled to the inflatable bladder, wherein the one or more inflatable extensions are configured to inflate when the inflatable bladder transitions from the deflated state to the inflated state.

18. The device as in claim 15, wherein when in the inflated state, the inflatable bladder is configured to occupy at least fifty percent of the volume of the enclosure.

19. The device as in claim 15, wherein the inflatable bladder is configured to inflate in multiple stages.

20. A method for decompressing foam, the method comprising:

an inflatable bladder transitioning from a deflated state to an inflated state upon air being applied to the interior of the inflatable bladder via a blower connection that is operably coupled to the inflatable bladder, wherein:

when in the deflated state the inflatable bladder is positioned along at least one of a bottom of an enclosure or a side of the enclosure, in the inflated state the inflatable bladder occupies a larger volume of the enclosure than a volume that the inflatable bladder occupies in the deflated state, and during the transition from the delated state to the inflated state the inflatable bladder displaces a plurality of foam pieces due to the exterior of the inflatable bladder contacting at least a portion of the plurality of foam pieces resulting in an increase in spacing between at least two of the foam pieces; and the inflatable bladder transitioning from the inflated state to the deflated state, wherein upon transitioning back to the deflated state the plurality of foam pieces are decompressed such that the plurality of foam pieces occupy a larger volume than a volume that the plurality of foam pieces had occupied prior to the transition of the inflatable bladder from the deflated state to the inflated state.

* * * * *